US006506080B2

(12) United States Patent
Hyland

(10) Patent No.: US 6,506,080 B2
(45) Date of Patent: Jan. 14, 2003

(54) RJ MODULAR CONNECTOR HAVING SUBSTRATE HAVING CONDUCTIVE TRACE TO BALANCE ELECTRICAL COUPLINGS BETWEEN TERMINALS

(75) Inventor: James Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/037,061

(22) Filed: Nov. 8, 2001

(65) Prior Publication Data

US 2002/0177366 A1 Nov. 28, 2002

Related U.S. Application Data

(63) Continuation-in-part of application No. 09/863,942, filed on May 22, 2001, now Pat. No. 6,413,121.

(51) Int. Cl.[7] ..... H01R 24/00

(52) U.S. Cl. ..... 439/676; 439/620; 439/941; 439/607; 439/83

(58) Field of Search ..... 439/676, 941, 439/607, 83, 620

(56) References Cited

U.S. PATENT DOCUMENTS 6,196,880 B1 * 9/1999 Goodrich et al. ..... 439/676
6,089,923 A * 7/2000 Phommachanh ..... 439/676
6,157,542 A * 12/2000 Wu ..... 361/752
6,176,742 B1 * 1/2001 Arnett et al. ..... 439/620

* cited by examiner

*Primary Examiner*—Tho D. Ta
*Assistant Examiner*—Truc Nguyen
(74) *Attorney, Agent, or Firm*—Wei Te Chung

(57) ABSTRACT

An RJ modular connector (1) includes a housing (10) defining a terminal insert receiving space (12). A terminal insert (20) is received in the terminal insert receiving space (12) and includes a substrate (3) having a plurality of conductive traces (30*a*–30*d*) and a plurality of terminals (21–28). One trace (30*a*) of the plurality of traces is aligned with only a selected terminal (21) attached on the second face (32) of the substrate while extends over a parallel terminal (22) and is electrically connected to another selected terminal (23) thereby establishing electrical coupling between said two selected terminals by said trace.

11 Claims, 9 Drawing Sheets

RJ MODULAR CONNECTOR HAVING SUBSTRATE HAVING CONDUCTIVE TRACE TO BALANCE ELECTRICAL COUPLINGS BETWEEN TERMINALS

EXTEND OVER-REFERENCE TO RELATED APPLICATIONS

This application is a continuation-in-part (C-I-P) application of copending application Ser. No. 09/863,942 filed on May 22, 2001, now U.S. Pat. No. 6,413,121.

BACKGROUND OF THE INVENTION

1. Field of the Invention

The present invention relates to a RJ modular connector, and more particularly to a RJ modular connector having a substrate provided therein to balance electrical couplings between terminals.

2. Description of Related Art

RJ modular connector has been widely used in telecommunication system since it was firstly created. A so-called RJ45 modular connector has been widely used in the network system.

The RJ45 modular connector includes totally eight terminals. Resulting from miniaturization of the computer, all corresponding components, including connectors, have to be reduced for their dimension and size. One of the negative consequences or problem created from miniaturization is electrical coupling between terminals. When the RJ connector is used in low speed signal transmission, the couplings between adjacent terminals can be ignored in light of its effect. However, when the RJ connector is used for high speed signal transmission, the couplings between adjacent terminals create a great problem. Unless the electrical coupling can be effectively controlled within an accepted level, it is unlikely that the RJ 45 modular connector can be used in the high-speed signal transmission.

One of the approaches is to select a pair of terminals as a differential pair. In the differential pair, two terminals transmit the same signal but with inverted phase. By this arrangement, the noise introduced thereto can be finally subtracted in a data processing unit.

As shown in an attached catalog from The Siemon Company, there are at least eight different patterns in selecting terminals as differential pair, i.e. T568A, T568B, USOC 4-pair, USOC 1-, 2- or 3-pair, 10BASE-T (802.3), Token Ring (802.5), 3-pair (MMJ), and TP-PMD (X3T9.5) and ATM. In each implementation, two terminals are selected as a pair in which some are close to each other, while some are apart from each other. Each pattern has its own uniqueness, while each also carries a coupling issue need to be solved.

Among those patterns, T568A and T568B are widely used and in T568A, terminals 1, 2 configure 3rd pair, terminals 3, 6 configure 2nd pair, terminals 4, 5 configure 1st pair, while terminals 7, 8 configure 4th pair. In T568B, terminals 1, 2 configure 2nd pair, terminals 3, 6 configure 3rd pair, terminals 4, 5 configure 1st pair, while terminals 7, 8 configure 4th pair.

Since those eight terminals are equally spaced, electrical couplings between terminals will surely create some problems, i.e. coupling or crosstalk. For example, if we take terminal 3 into consideration, terminal 3 will naturally pick up energy coupled from terminals 2, and 4 which are close to terminal 3. On the other hand, terminal 6, which carries signal having inverted phase of the signal carried by terminal 3, will also pick up energy coupled from terminals 5 and 7. However, energy coupled into terminals 3, 6 from terminals 2 and 7 can not be suitably eliminated because terminals 3, 6 is unlikely to establish couplings between terminals 1 and terminals 8 to balance the couplings between terminals 2, 3 and 6, 7. Accordingly, signals transmitted by terminals 3, 6 carry noises generated by their adjacent terminals 2, 7. In addition, terminals 3 and 6 will also carry noises coupled thereto from terminals 4, 5 and which couplings should be also carefully taken to avoid certain noises.

In order to decrease the effects of electrical coupling between the (3rd, 4th) and (3rd, 2nd) terminals, and (6th, 5th) and (6th, 7th) terminals, many approaches have been provided, such as creating electrical couplings between 3rd and 1st terminals and 3rd and 5th terminals, to balance the electrical coupling between the 3rd and 2nd terminals and 3rd and 4th terminals, and creating electrical coupling between 6th and 8th terminals and 6th and 4th terminals to balance the electrical couplings between the 6th and 7th terminals and 6th and 5th terminals.

However, as mentioned above, those eight terminals are arranged in a common plane, it is impossible to create those balancing electrical couplings, i.e. (1st, 3rd), (3rd, 5th), and (4th, 6th), (6th, 8th) terminals when all terminals are located in the same level, it is unlikely to create any electrical channels therebetween to create those electrical couplings accordingly.

The Siemon Company, a US company, discloses a solution posted on the Internet, http://www.siemon.coni/white_papers/99-08-30-through-hole.asp. A hard copy thereof is herein attached for reference.

As clearly shown in FIG. 4 of that reference, 6th and 2nd terminals are arranged in the first layer, while 8th, 5th, 4th, and 1st terminals are arranged in the second layer, and 7th and 3rd terminals are arranged in the third layer.

The 6th terminal in the first layer has a rectangular loop having its longitudinal sides aligned with terminals 4th and 8th located in the second layer, while terminal 3 in the third layer also has a rectangular loop having its longitudinal sides aligned with terminals 5th and 1st located in the second layer.

In addition, the right longitudinal loop side of the terminal 6th further includes a square corresponding to a square formed in terminal 4th. The left longitudinal loop side of the terminal 3 includes also a square with respect to the square formed on terminal 5th.

Arrangements suggested by Siemon are to increase the couplings between (1st, 3rd), (3rd, 5th), and (4th, 6th), (6th, 8th) terminals thereby helping to balance electrical couplings of the terminals.

However, those eight or four set sets of terminals are arranged in three different layers, and each set of terminals are separately divided by an insulative sheet material. This will no doubt increase the complexity of the connector.

In addition, there are different shapes and configurations among those eight terminals. Each terminal has its own shape which is different from each other, especially the 3rd and 6th terminals, each including the rectangular loop portion which overlap to corresponding terminals to create wanted electrical couplings. Each loop further forms the square to increase the electrical couplings with corresponding terminals having the square. The electrical couplings created can help to meet higher system requirements. The eight different configurations of the terminals will surely increase the difficulty and complexity in production.

There are some other approaches that including routing terminal tails of those 3rd, 6th and 4th, 5th terminals to alter their position and affect couplings between 3rd, 2nd and 3rd, 4th; and 6th, 5th, and 6th, 7th terminals. However routing terminal tails will inevitably increase the manufacturing cost.

U.S. Pat. No. 6,120,329 issued to Steinman on Sep. 19, 2000, discloses another approach to solve the above-addressed problem. Again, terminals are configured with different shapes and dimensions making the production complex.

U.S. Pat. No. 5,069,641 issued to Sakamoto et al. discloses a suggestion of using substrate in the RJ modular housing, however, it is addressed to different issues.

SUMMARY OF THE INVENTION

It is an object of this invention to provide an RJ modular connector, and more particularly to a RJ modular connector having a substrate with conductive traces provided thereon to balance electrical couplings between terminals.

It is still an object of this invention to provide a RJ modular connector which can be easily manufactured.

In order to achieve the objective set forth, an RJ modular connector in accordance with the present invention comprises a housing defining a plug receiving section, and a terminal insert receiving section. A terminal insert is received in the terminal insert receiving section and includes a substrate having a plurality of conductive traces and a plurality of terminals. Each trace has a large portion which is aligned with only a selected terminal soldered on the second surface of the substrate and a small portion which is electrically connected to another selected terminal whereby electrical coupling is established between said two selected terminals by said trace.

Other objects, advantages and novel features of the invention will become more apparent from the following detailed description when taken in conjunction with the accompanying drawings.

DETAILED DESCRIPTION OF THE INVENTION

Figure 1:
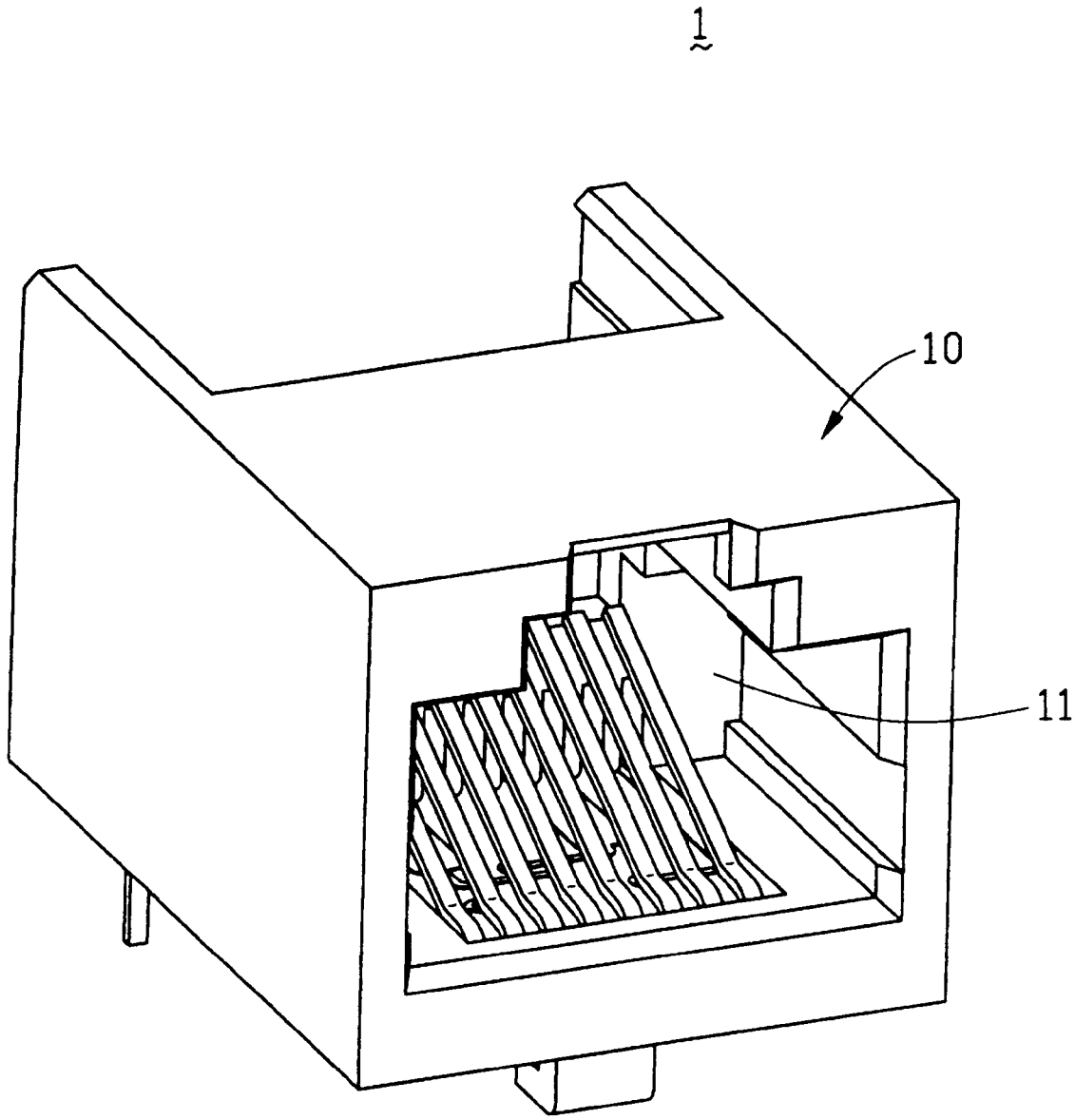
FIG. 1 is a perspective view of a RJ modular connector in accordance with the present invention.
Figure 2:
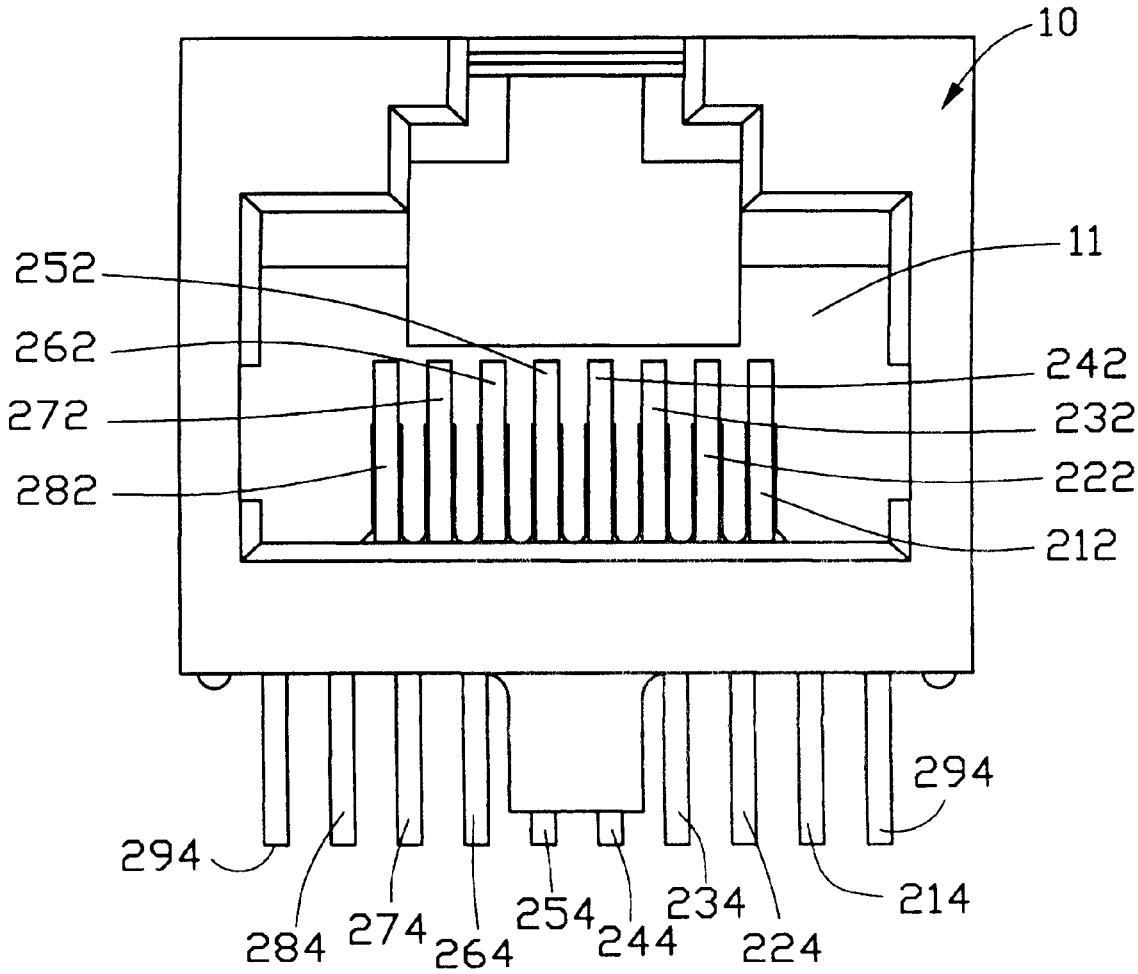
FIG. 2 is a front view of the RJ modular connector of FIG. 1.
Figure 3:
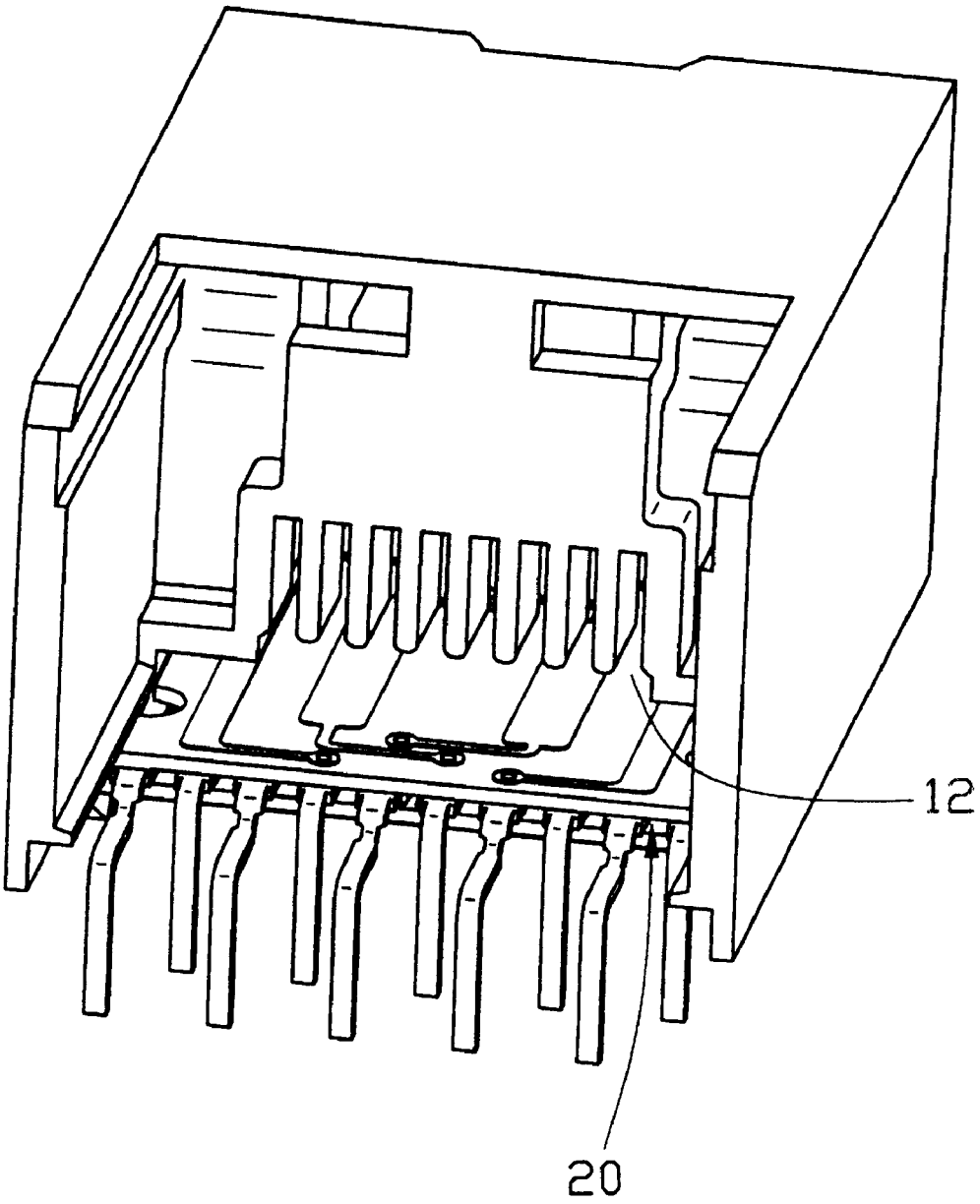
FIG. 3 is another perspective view of the RJ modular connector of FIG. 1.
Figure 4:
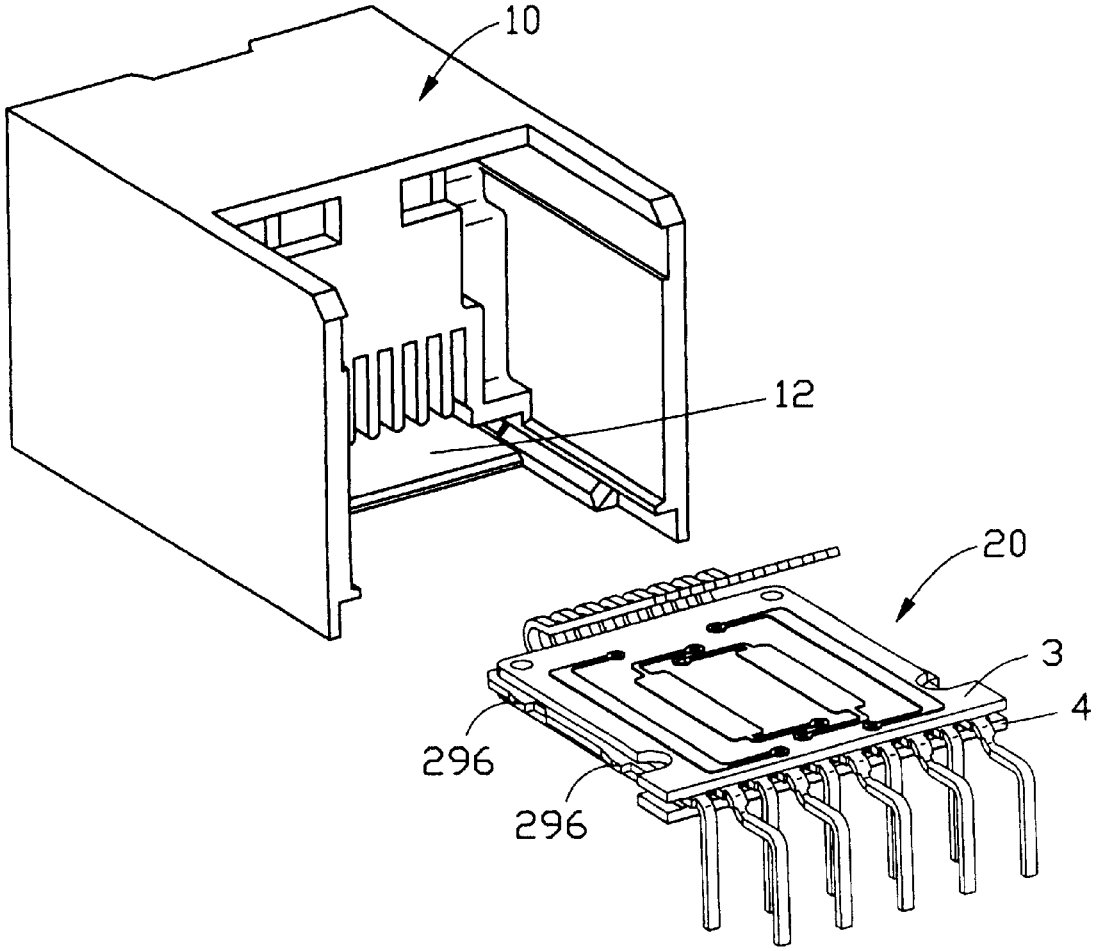
FIG. 4 is exploded view of the modular connector to show a terminal insert and a housing of the modular connector.
Figure 5:
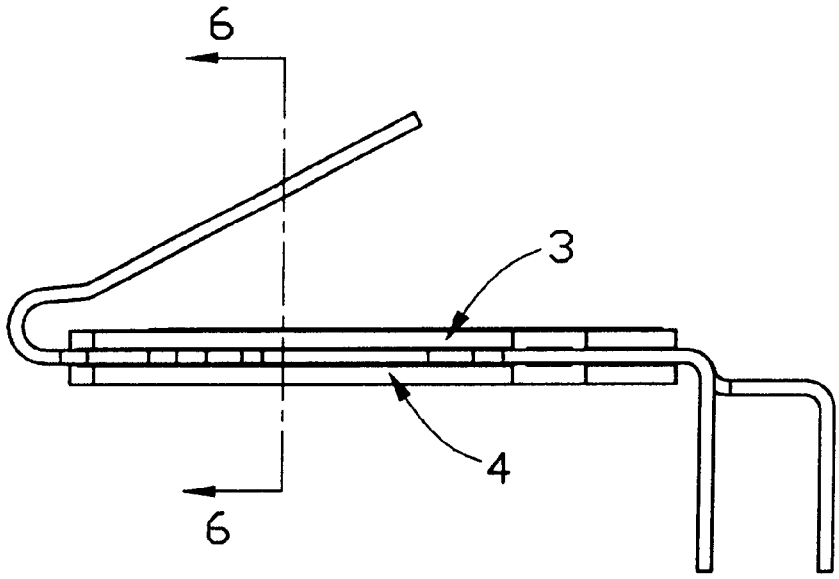
FIG. 5 is a side view of the terminal insert of the RJ modular connector of the present invention.
Figure 6:
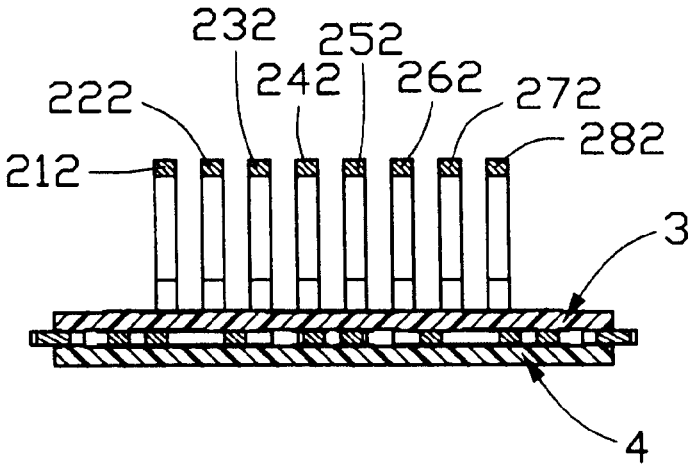
FIG. 6 is a extend over-sectional view of the terminal insert of FIG. 5 taken along line 6—6.

For facilitating understanding, like components are designated by like reference numerals throughout the various embodiments of the invention as shown in the various drawing figures.

Referring to FIGS. 1–4, a RJ modular connector 1 in accordance with the present invention includes an insulative housing 10, and a modular terminal insert 20. The housing 10 defines a plug receiving space 11 in a front end for mating with a complement connector (not shown), and a terminal insert receiving space 12 in a rear end of the housing 10 for receiving the modular terminal insert 20.

Referring to FIGS. 4–11, the modular terminal insert 20 comprises an upper substrate 3, a lower substrate 4 and eight signal terminals 21, 22, 23, 24, 25, 26, 27 and 28 and two conductor 29 for being sandwiched between the upper substrate 3 and the lower substrate 4. The upper substrate 3 has a first surface 31, a second surface 32 opposite the first surface 31, a first side 33, and a second side 34 opposite the first side 33. Among the signal terminals, signal terminals 21, 22 configures a first differential pair, signal terminals 23, 26 configures a second differential pair, signal terminals 24, 25 configures a third differential pair, while terminals 27, 28 configures a fourth differential pair.

The upper substrate 3 defines four conductive traces 30*a*, 30*b*, 30*c* and 30*d* on the first surface 31 arranged side by side. The first and second traces 30*a* and 30*b* are close to the first side 33 of the substrate 3. The third and fourth traces 30*c* and 30*d* are close to the second side 34 of the substrate 3. Each of the four conductive traces 30*a*, 30*b*, 30*c* and 30*d* has a large portion 130*a*, 130*b*, 130*c* and 130*d* and a pair of small portions 230*a*, 230*b*, 230*c* and 230*d* connected to a pair of ends of the large portion 130*a*, 130*b*, 130*c* and 130*d*. Each small portion 230*a*, 230*b*, 230*c* and 230*d* has a via 330*a*, 330*b*, 330*c* and 330*d* at a free end thereof extending from the first surface to the second surface 32 of the upper substrate 3. The first and second small traces 230*a* and 230*b* are extended toward the second side 34 of the upper substrate 3. The third and fourth small traces 230*c* and 230*d* are extended toward the first side 33 of the upper substrate 3. The large portion 130*b*, 130*c* all have a first width, and the large portion 130*a*, 130*d* all have a second width. The first width is larger than the second width.

Figure 9:
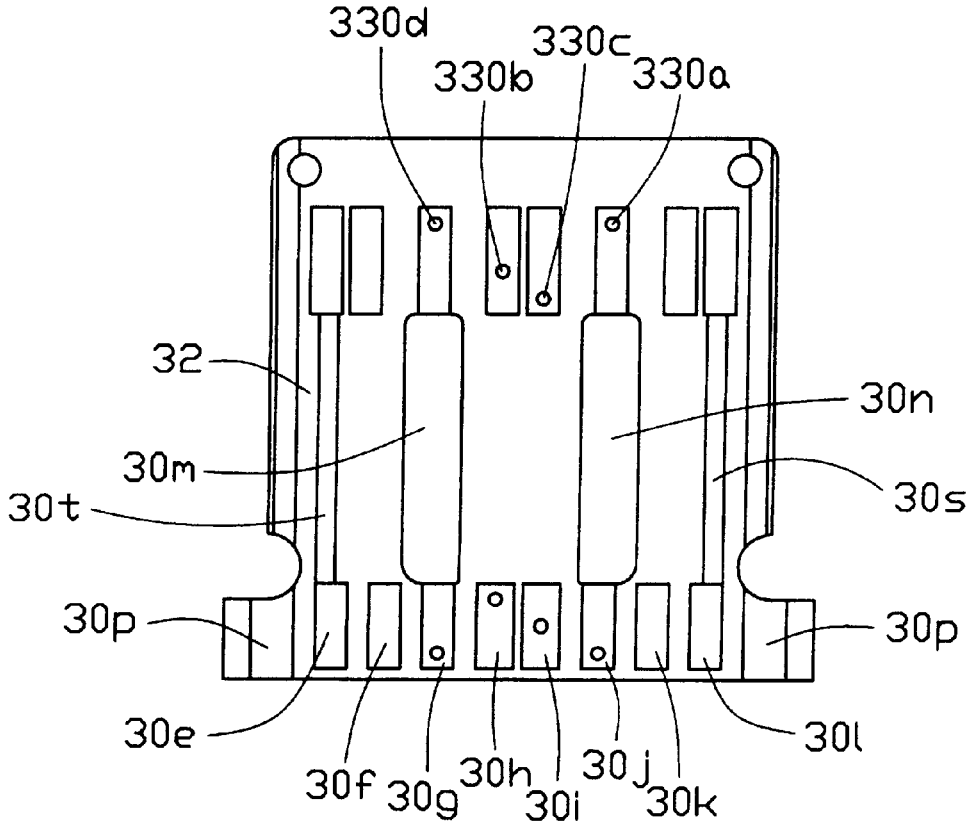
FIG. 9 is a bottom view of the upper substrate of the terminal insert of FIG. 7.

Referring to FIG. 9, the upper substrate 3 has eight pairs of solder pads 30*l*, 30*k*, 30*j*, 30*i*, 30*h*, 30*g*, 30*f*, 30*e* arranged side by side on the second surface 32 thereof. A first connection trace 30*n* is located between the pair of third solder pads 30*j* and is electrically connected therebetween. A second connection trace 30*m* is located between the pair of sixth solder pads 30*g* and is electrically connected therebetween. A third connection trace 30*s* is located between the pair of first solder pads 30*l* and is electrically connected therebetween. A fourth connection trace 30*t* is located between the pair of eighth solder pads 30*e* and is electrically connected therebetween. Meanwhile, on the second surface, the first and second connection traces 30*n* and 30*m* all have a third width, and the third and fourth connection traces 30*s* and 30*t* all have a fourth width. The third width is wider than the fourth width. A pair of side pads 30*p* is defined on the second surface 32 of the upper substrate 3 separately completely extending along the first side 33 and the second side 34.

Referring to FIG. 9, each via 330*a*, 330*b*, 330*c* and 330*d* is electrically connected with corresponding solder pad 30*j*, 30*h*, 30*i* and 30*g* on the second surface 32.

Figure 7:
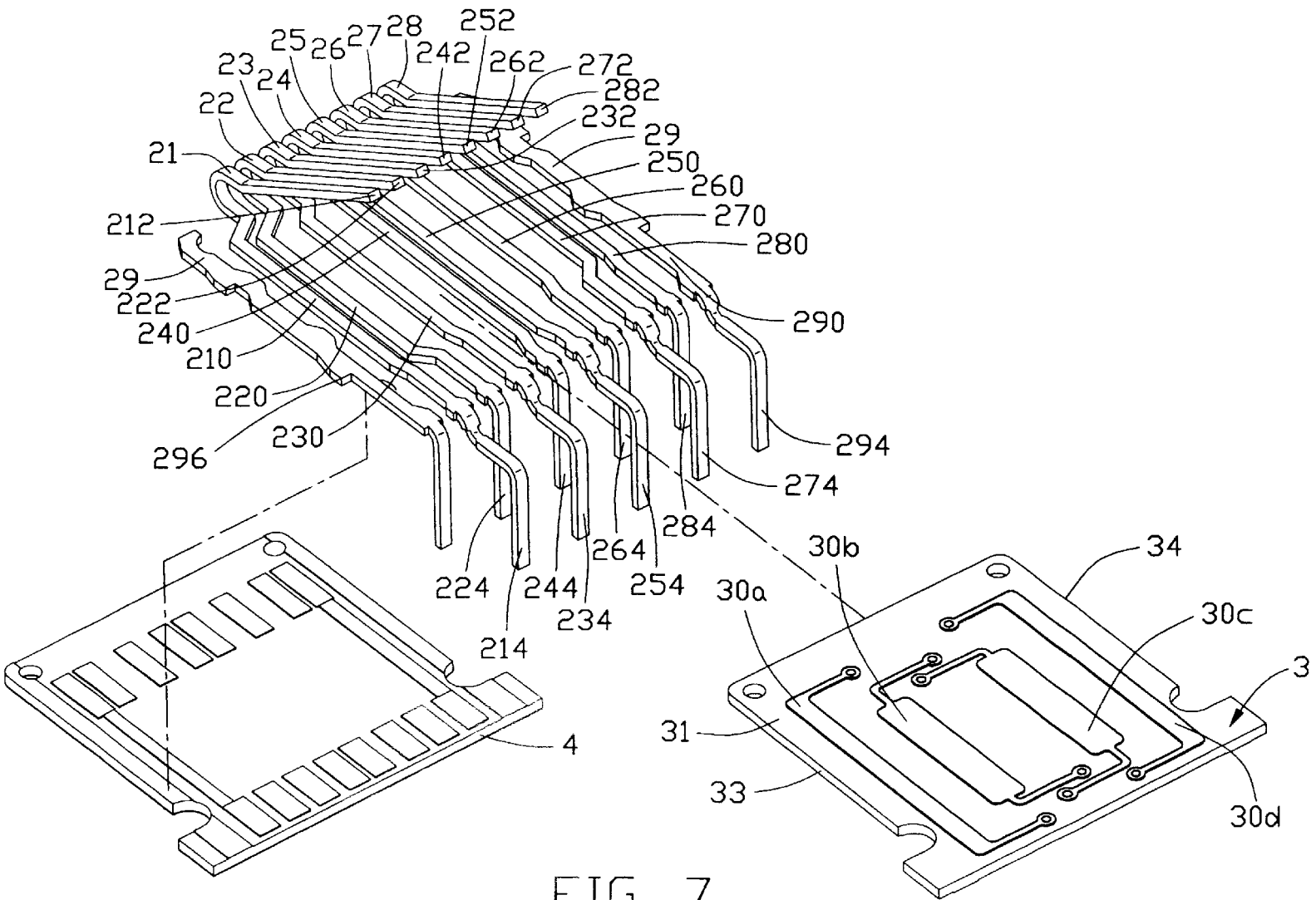
FIG. 7 is an exploded view of the terminal insert with an upper substrate separating therefrom.
Figure 8:
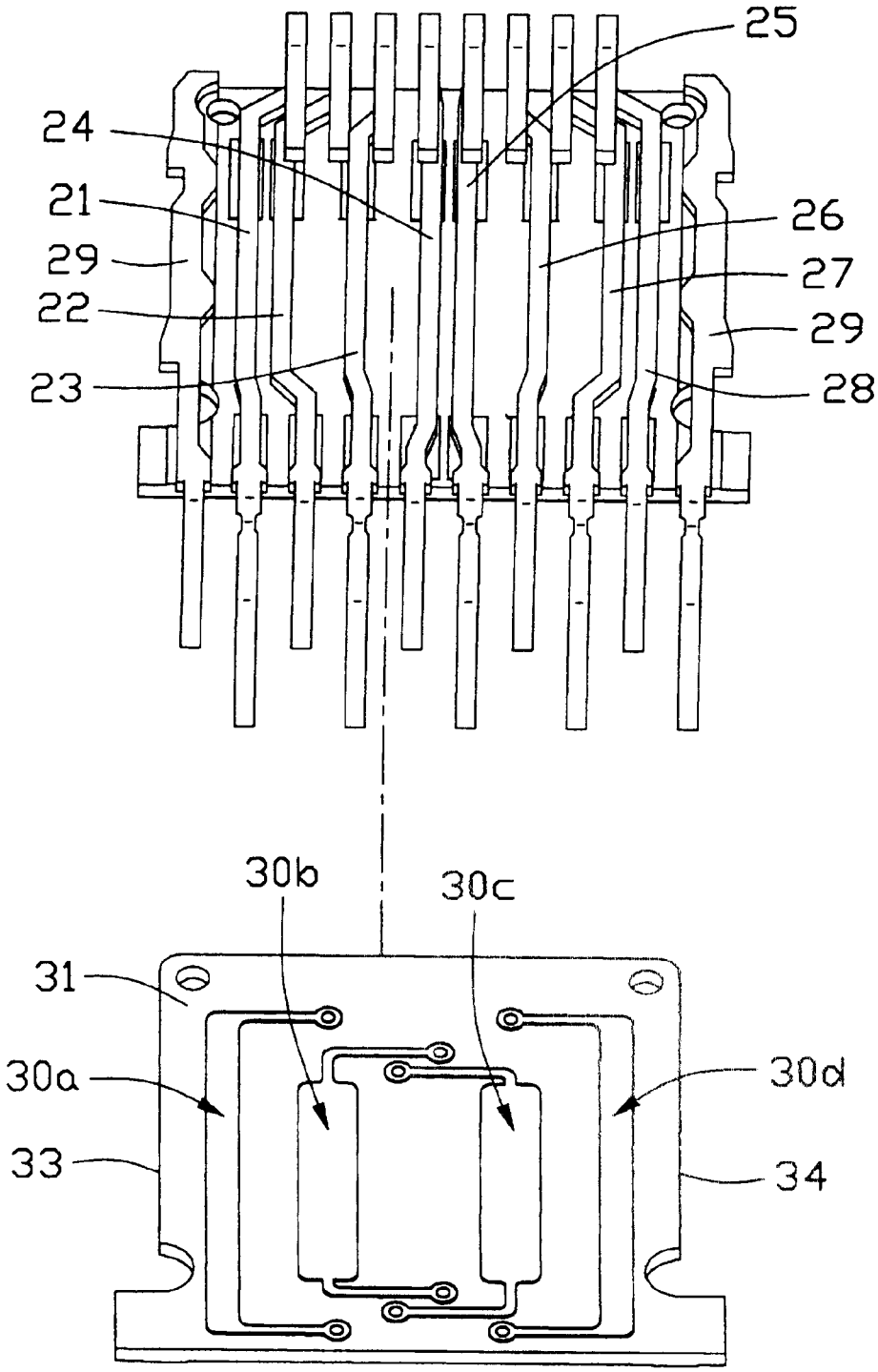
FIG. 8 is another exploded view of the terminal insert with the upper substrate separating therefrom.

Referring to FIGS. 7 and 8, each signal terminal 21, 22, 23, 24, 25, 26, 27 and 28 has a middle portion 210, 220, 230, 240, 250, 260, 270 and 280, a contact portion 212, 222, 232, 242, 252, 262, 272 and 282 at one end of the middle portion and being bent to an angle and a solder portion 214, 224, 234, 244, 254, 264, 274 and 284 bending downwardly for being soldered to a mother board (not shown). A first distance between one terminal of the first, third, fourth differential pairs signal terminals 21, 22, 24, 25, 27 and 28 to one terminal of the second differential pair signal terminals 23 and 26 is larger than a second distance between the two terminals adjacent to each other in one differential pair terminals 21 and 22 or 24 and 25 or 27 and 28. Each conductor 29 has a side beam 290 and a ground tail 294 bending downwardly for being soldered to the motherboard. The ground tail 294 will bring ground into the modular terminal insert 20 from the motherboard. Each side beam 290 has a plurality of barbs 296 for interfering with the housing 10 and securing the modular terminal insert 20 to the housing 10.

The modular terminal insert 20 further comprises a lower substrate 4 which has a plurality of solder pads (not labeled) on an upper surface corresponding to the solder pads 30*l*, 30*k*, 30*j*, 30*i*, 30*h*, 30*g*, 30*f*, 30*e* and 30*p* of the upper substrate 3. A bottom surface of the lower substrate 4 is made of conductive material, which can help to prevent electrical influence to the modularjack connector 1. The middle portions 210, 220, 230, 240, 250, 260, 270, 280 of the signal terminals 21, 22, 23, 24, 25, 26, 27 and 28 are surface mounted on the solder pads of the upper surface of the lower substrate 4. The side beams 290 of the conductors 29 are surface mounted on the solder pads 30*p* of the upper surface of the lower substrate 4 separately. The signal terminals 21, 22, 23, 24, 25, 26, 27 and 28 and conductors 29 are correspondingly soldered with the solder pads 30*l*, 30*k*, 30*j*, 30*i*, 30*h*, 30*g*, 30*f*, 30*e* and 30*p* of the second surface 32 of the upper substrate 3 whereby the first trace 30*a* aligns with the first terminal 21, the second trace 30*b* aligns with the third terminal 23, the third trace 30*c* aligns with the sixth terminal 26 and the fourth trace 30*d* aligns with the eighth terminal 28, the vias 330*a* of the first trace 30*a* electrically connect with the pair of pads 30*j*, the vias 330*b* of the second trace 30*b* electrically connect with the pair of pads 30*h*, the vias 330*c* of the third trace 30*c* electrically connect with the pair of pads 30*i*, and the vias 330*d* of the fourth trace 30*d* electrically connects with the pair of the pads 30*g*. The side beams 290 increase the solder area with the upper and the lower substrates 3 and 4 and are securely soldered with the upper and lower substrates 3 and 4 together. The small portions 230*b* of the second trace 30*b* on the first surface 31 of the upper substrate 3 extend over the fourth signal terminal 24 on the second surface 32, and the small portions 230*c* of the third trace 30*c* on the first surface 31 of the upper substrate 3 extend over the fifth signal terminal 25 on the second surface 32.

Figure 10:
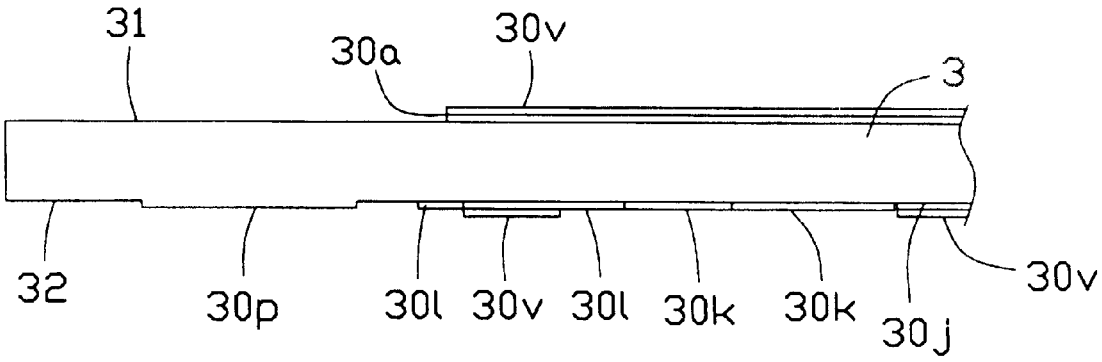
FIG. 10 is an enlarge side view of a left part of the upper substrate of the terminal insert of FIG. 7.
Figure 11:
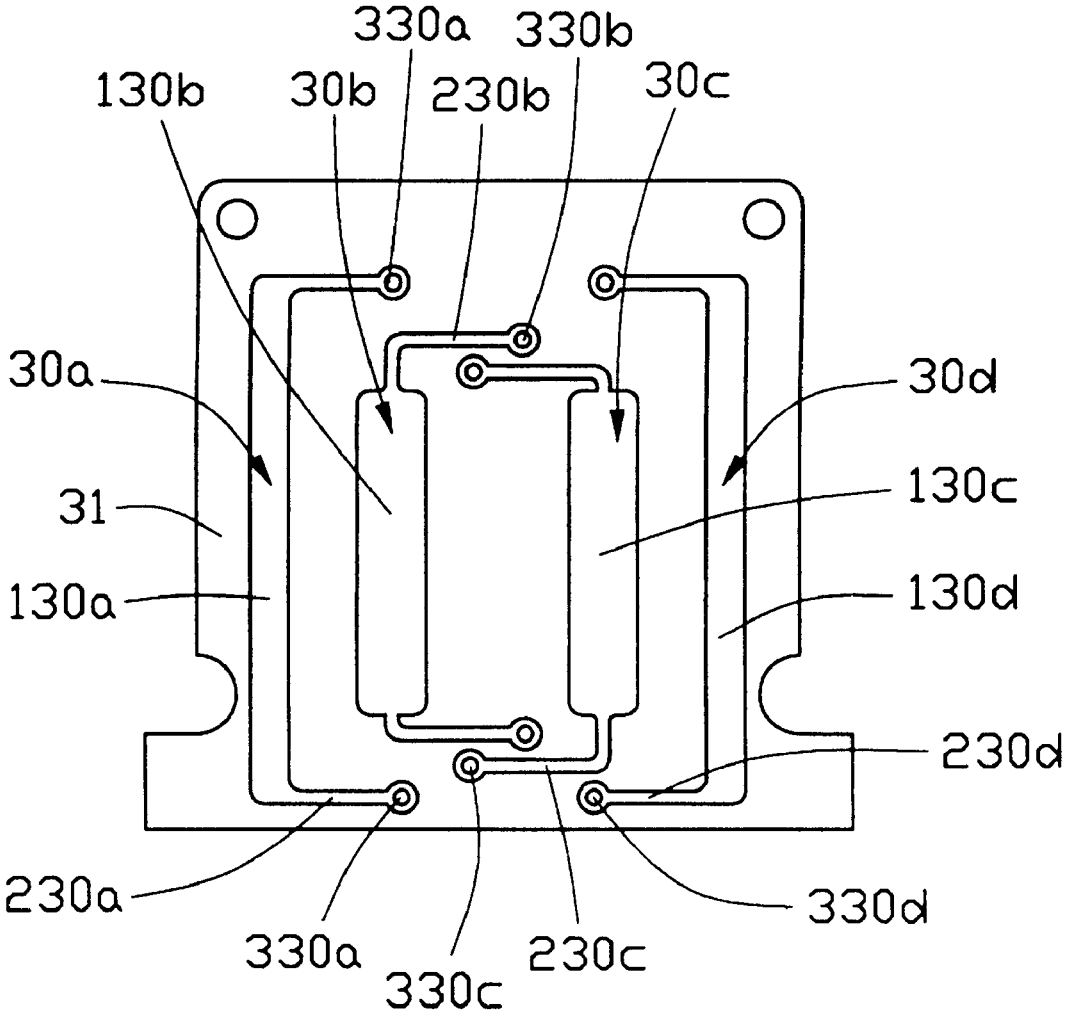
FIG. 11 is a top view of the upper substrate of the terminal insert of FIG. 7.

Referring to FIG. 10, each trace 30*a*, 30*b*, 30*c*, 30*d*, 30*n*, 30*m*, 30*s*, 30*t* has an insulative film 30*v* attached thereon for insulating the trace.

Because electrical coupling between the first signal terminal 21 and the third signal terminal 23 is established, electrical influence to the third signal terminal 23 created by the second signal terminal 22 can be better balanced to help improve crosstalk performance. Because electrical coupling between the third signal terminal 23 and the fifth signal terminal 25 is established, electrical influence to the third signal terminal 23 created by the fourth signal terminal 24 can be better balanced to help improve crosstalk performance. Because electrical coupling between the fourth signal terminal 24 and the sixth signal terminal 26 is established, electrical influence to the sixth signal terminal 26 created by the fifth signal terminal 25 can be better balanced to help improve crosstalk performance. Because electrical coupling between the sixth signal terminal 26 and the eighth signal terminal 28 is established, electrical influence to the sixth signal terminal 26 created by the seventh signal terminal 27 can be better balanced to help improve crosstalk performance. The conductors 29 are correspondingly soldered first and second sides 33, 34 of the upper substrate 3 to connect the upper substrate 3 and the lower substrate 4 together.

The modular terminal insert 20 is correspondingly inserted and secured in the terminal insert receiving space 12 of the housing 10 with the barbs 296 of the conductors 29 interfering with the housing 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A RJ modular connector, comprising:

a housing defining a plug receiving section, and a terminal insert receiving section;

a terminal insert received in the terminal insert receiving section, the terminal insert being configured by a substrate and a plurality of signal terminals attached to the substrate, the substrate having a plurality of traces on a first surface thereof and a plurality of solder pads on a second surface thereof with the terminals correspondingly attached thereto; and wherein one trace of the plurality of traces is aligned with a selected terminal and electrically connects another selected terminal whereby electrical coupling is established between these two selected terminals by said trace, wherein each trace on the first surface of the substrate has a large portion aligning with the selected terminal and at least one small portion connected with one end of the large portion;

wherein the large portions of a first group of the traces all have a first width, and the large portions of a second group of the traces all have a second width, the first width is larger than the second width.

2. The RJ modular connector as claimed in claim 1, wherein a parallel terminal of said plurality of signal terminals is located between the selected terminals coupling with each other.

3. The RJ modular connector as claimed in claim 2, wherein the small portion extends over the parallel terminal located between said selected terminals.

4. The RJ modular connector as claimed in claim 1, wherein each small portion has a via at an end thereof.

5. The RJ modular connector as claimed in claim 4, wherein each via of the trace extends through the substrate from the first surface to the, second surface to electrically connect with a corresponding solder pad being formed on the second surface of the substrate.

6. The RJ modular connector as claimed in claim 5, wherein a plurality of parallel connection traces are formed on the second surface of the substrate, and each connection trace on the second surface is connected to at least one of selected solder pad on the second surface.

7. The RJ modular connector as claimed in claim 6, wherein a first group of connection traces on the second surface of the substrate all have a third width and correspondingly align with the large portions of the first group traces on the first surface, and a second group of connection traces on the second surface of the substrate all have a fourth width and correspondingly align with the large portions of the second group traces on the first surface of the substrate.

8. The RJ modular connector as claimed in claim 1, wherein the terminal insert further comprises a lower substrate, the upper and the lower substrates together sandwich the signal terminals therebetween.

9. The RJ modular connector as claimed in claim 8, wherein the connector further comprises at least one conductor, and each conductor has a side beam being sandwiched by the upper and lower substrates and attaches the upper and the lower substrates together.

10. The RJ modular connector as claimed in claim 9, wherein said side beam of the conductor further comprises a plurality of barbs interfering with the housing of the modular connector thereby securing the terminal insert to the housing.

11. The RJ modular connector as claimed in claim 10, wherein the conductor further comprises a ground tail connecting the ground from the motherboard to the terminal insert.

* * * * *